US007120974B2

(12) United States Patent
Suganuma

(10) Patent No.: US 7,120,974 B2
(45) Date of Patent: Oct. 17, 2006

(54) CLASP FOR USE WITH BOTH A BROOCH AND PENDANT

(76) Inventor: Tomoyuki Suganuma, Atoriejupiku Kabushiki-Kaisha, Nikaido 75, Kamakura-shi, Kanagawa (JP)

( * ) Notice: Subject to any disclaimer, the term of this patent is extended or adjusted under 35 U.S.C. 154(b) by 157 days.

(21) Appl. No.: 10/927,593

(22) Filed: Aug. 27, 2004

(65) Prior Publication Data

US 2005/0044676 A1 Mar. 3, 2005

(30) Foreign Application Priority Data

Aug. 28, 2003 (JP) ..... 2003-004410

(51) Int. Cl.
*A44B 9/16* (2006.01)
*A44C 25/00* (2006.01)
*A44C 1/00* (2006.01)

(52) U.S. Cl. ..... 24/708; 24/709.2; 63/21; 63/40

(58) Field of Classification Search ..... 24/708, 24/709.2, 489; 63/3.1, 4, 1.11, 1.18, 40, 63/20, 21, 23
See application file for complete search history.

(56) References Cited

U.S. PATENT DOCUMENTS 323,543 A * 8/1885 Thommen ..... 24/709.2
1,004,592 A * 10/1911 Rhodes ..... 24/709.2
1,034,136 A * 7/1912 Morehouse ..... 24/708
1,056,356 A * 3/1913 Munson ..... 24/709.2
1,249,519 A * 12/1917 Schroitter ..... 24/709.2
3,020,614 A * 2/1962 De Curtis et al. ..... 24/708

FOREIGN PATENT DOCUMENTS

JP 69512 2/1994
JP 3087633 5/2002

* cited by examiner

*Primary Examiner*—Robert J. Sandy
(74) *Attorney, Agent, or Firm*—Stevens, Davis, Miller & Mosher, LLP

(57) ABSTRACT

A clasp for use with both a brooch and a pendant has a support piece having a tip end bent is provided on one surface of a brooch main body, and a rear end of a needle-shaped latch supported on the tip end of the support piece to be free to rotate in a vertical direction. A leg of the needle-shaped latch protrudes from the vicinity of a pivot portion of the latch, and a space surrounded at least in part by the support piece forms a chain insertion portion. When a pendant chain is passed through the chain insertion portion of the support piece, and the tip end of the latch is latched by a latch receiver on the brooch main body, a lower end of the leg abuts against or comes close to one surface of the brooch main body, thereby closing the chain insertion portion.

10 Claims, 7 Drawing Sheets

CLASP FOR USE WITH BOTH A BROOCH AND PENDANT

This claims priority under 35 USC 119 from Japanese Utility Model Application No. 2003-004410, filed 28 Aug. 2003 and Japanese Patent Application No. 2003-384280, filed 13 Nov. 2003, both of which are incorporated herein by reference in their entirety.

BACKGROUND OF THE INVENTION

1. Field of the Invention

The present invention relates to a clasp for use with both a brooch and a pendant which, when attached to a brooch, enables the brooch to be used as a pendant.

2. Description of the Related Art

People have conventionally enjoyed dressing up by attaching a brooch to their clothing or hanging a pendant from their necks. As shown in FIG. 16, at present a brooch is usually attached to a piece of clothing using a brooch clasp G fixed to the rear surface of a brooch main body F. This type of brooch clasp G is formed by supporting one end portion of a needle-shaped latch 12 rotatably on one end of the rear surface of the brooch main body F, and providing a latch receiver 13 for latching the sharp tip end of the latch 12 on the other end of the brooch main body F.

In the latch receiver 13, as shown in FIG. 17, a tubular portion 14 provided with a flange portion 14*a* on its rear end is fitted into the inside of a cylinder 13*b*, which has a mountain-shaped (triangular) cut-away portion 13*a* formed in one end side thereof, from the other end side thereof. The flange portion 14*a* is then moved (in the direction of the arrow in FIG. 17) by gripping the flange portion 14*a* such that the tubular portion 14 is inserted into and removed from the cylinder 13*b* of the latch receiver 13, and thus the needle-shaped tip end of the latch 12 can be latched inside the tubular portion 14.

Meanwhile, the owner of a brooch may sometimes wish to use the brooch as a pendant. In a device for use in such a case, disclosed in the laying open of Japanese Utility Model Application H6-9512 and shown in FIG. 18, a through hole 20 through which a chain or the like can be passed is provided in a brooch pin 19 serving as a brooch clasp. Thus, when the brooch 22 is to be used as a pendant, a chain or the like is passed through the through hole 20 provided in the brooch pin 19 such that the brooch 22 hangs on the chain. The brooch 22 can then be used as a pendant.

In a further device disclosed in Japanese Utility Model Registration Publication No. 3087633 and shown in FIG. 19, a rear surface side of a pendant 24 on a pin brooch 23 provided with a pendant is formed with a chain insertion formation 26 fixed to a rear surface plate portion 25 which is a part of the pendant 24. A chain insertion portion 27 is formed between the rear surface plate portion 25 and the chain insertion formation 26. A pin insertion tube 28 is welded to the rear surface plate portion 25, and a pin 29 is inserted into the pin insertion tube 28. A substantially U-shaped spring portion 30 is formed integrally with the insertion tube 28, and a spherical abutting portion 31 is formed on the tip end of the spring portion 30. The spherical abutting portion 31 abuts against the rear surface plate portion 25 so as to urge the rear surface plate portion 25. When the pin brooch 23 is to be used as the pendant 24, the pin 29 is removed, and a separately provided chain is passed through the chain insertion portion 27 and hung around the neck for use as a pendant.

However, in the former case, the through hole 20 for passing through a chain or the like is provided in a narrow location between the brooch pin 19, a bearing 21 for opening and closing the pin, and the brooch 22. Moreover, the through hole 20 for passing through a chain or the like is formed into a ring without the opening, and in reality, it is difficult to pass a chain through the through hole 20. Furthermore, only chains having a width that is equal to or less than the inner diameter of the through hole 20 can be passed through the through hole 20.

In the latter case, the chain insertion portion 27 required for use as the pendant 24, the pin insertion tube 28 required for use as a brooch, the pin 29, the spring portion 30, the spherical abutting portion 31, and so on must all be provided separately. Moreover, when the pin brooch 23 is to be used as the pendant 24, the pin 29 protrudes from the pendant 24, and hence the pin 29 must always be removed, which is tiresome.

SUMMARY OF THE INVENTION

The present invention has been designed in consideration of these points, and it is an object thereof to provide a compact clasp for use with both a brooch and a pendant which can be opened and closed by a support piece of a latch on the brooch clasp and a leg suspended from the latch, and which is provided with a chain insertion portion for a pendant through which a chain or the like can be passed easily.

A first embodiment of the invention is a clasp for use with both a brooch and a pendant, comprising a needle-shaped latch, a rear end of which is supported on one end of one surface of a brooch main body so as to be free to rotate (pivot) in a vertical direction, and a latch receiver for latching a tip end of the latch, which is provided on another end of the one surface of the brooch main body. The clasp is attached to a piece of clothing by latching the latch passed through a part of the piece of clothing to the latch receiver. A narrow support piece, having a tip end (distal relative to the brooch main body) which is bent into a substantial right angle to the direction of an opposed opening of the latch receiver, is provided on the one end of the one surface of the brooch main body. The rear end of the needle-shaped latch is supported on a tip end of the support piece so as to be free to rotate (pivot) in a vertical direction. A leg protrudes toward the one surface of the brooch main body from the vicinity of a pivot portion of the latch. A space surrounded by the support piece and the one end of the one surface of the brooch main body forms a chain insertion portion. Thus, when a pendant chain is passed through the chain insertion portion of the support piece and the tip end of the latch is latched by the latch receiver provided on the other end of the one surface of the brooch main body, a lower end of the leg of the latch abuts against or comes close to the one surface of the brooch main body. As a result, the chain insertion portion is closed so that the pendant chain cannot become disengaged from the chain insertion portion.

If desired in another embodiment of the invention the above-described clasp for use with both a brooch and a pendant, the rear end (proximal to the brooch main body) of the support piece extends in a substantially identical direction to the bent tip end of the support piece to form a base. In this embodiment, the chain insertion portion is formed by the base and the support piece, such that when the leg extending from the vicinity of the pivot portion of the latch abuts against or comes close to the base, the chain insertion portion is closed.

Another embodiment of the invention comprises a clasp for use with both a brooch and a pendant, comprising a needle-shaped latch, a rear end of which is supported on one end of one surface of a brooch main body so as to be free to rotate (pivot) in a vertical direction, and a latch receiver for latching a tip end of the latch, which is provided on another end of the one surface of the brooch main body. The clasp is attached to a piece of clothing by latching the latch passed through a part of the piece of clothing to the latch receiver. A horizontal base is fixed to one edge of the one surface of the brooch main body, a tip end of the base is formed into a support piece bent into an arc-shaped profile, one end of a latch base having an arc-shaped profile is supported on the tip end of the support piece so as to be free to rotate in a vertical direction, another end of the latch base is provided so as to be free to abut against or come close to the base, an annular body protruding from the one end of the brooch main body is formed by the support piece and the latch base, the space inside the annular body constitutes a chain insertion portion, and the needle-shaped latch portion is provided from the latch base to the latch receiver. Thus, when a pendant chain is passed through the chain insertion portion and the tip end of the latch is latched by the latch receiver, the chain insertion portion is closed by the latch base so that the pendant chain cannot become disengaged from the chain insertion portion.

The above-described embodiments of a clasp for use with both a brooch and a pendant according to the present invention may employ a stopper for latching the lower end of the leg, which extends from the vicinity of the pivot portion of the latch in order to close the chain insertion portion formed by the support piece and the one surface of the brooch main body or the base formed by extending the support piece. The stopper is provided on the one surface of the brooch main body or the base of the support piece in the position at which the lower end of the leg abuts against or comes close to the one surface of the brooch main body or the base of the support piece.

The clasps of the present invention for use with both a brooch and a pendant may comprise a pendant chain insertion portion formed by the support piece of the latch and one end of the one surface of the brooch main body or the base. Hence, the clasp is compact and no larger than required, and the pendant chain that is passed through the chain insertion portion does not move needlessly. The clasp part of a pendant chain is often larger than the sectional area of the chain part, but since the chain insertion portion is provided to be opened and closed freely, this type of chain can be passed through the chain insertion portion, even when the chain insertion portion is narrow, without problems. Since there is no need to take the trouble to provide a plectrum-shaped ring or D-shaped ring, the length of the needle-shaped latch of the brooch can be extended, ensuring easy and secure latching to a piece of clothing. Moreover, since the chain insertion portion is small, the brooch can be hung from the neck as a pendant with stability. Moreover, the pendant does not turn around, and hence the wearer can feel at ease and enjoy dressing up. Further, the leg abuts against or comes close to the one surface of the brooch main body such that when the needle-shaped latch is pushed inward from a state in which it is substantially parallel with the one surface of the brooch main body or the base, a spring effect is exhibited whereby the leg does not move and the latch springs upward in reaction to the pushing. Hence, when the needle-shaped latch is pierced into a piece of clothing during use of the clasp with a brooch, the tip end of the latch springs upward, enabling the piece of clothing to be pierced easily.

In the embodiment wherein a base is constituted by extending the rear end of the support piece in a substantially identical direction to the bent tip end of the support piece, and the chain insertion portion is formed by the base and the support piece such that when the leg extending from the vicinity of the pivot portion of the latch abuts against or comes close to the base, the chain insertion portion is closed. Hence, even when the attachment surface of the brooch main body is uneven, the base can be attached as long as a slight contact surface can be secured between the uneven surface and the base. As a result, the versatility of the clasp for use with both a brooch and a pendant is increased, and the scope of usage is widened.

In the embodiment of the invention employing a support piece bent into an arc-shaped profile, an annular body protruding from one end of the brooch main body is formed by the support piece and the latch base, and hence when a necklace having narrow gaps between adjacent precious stones, formed by stringing together precious stones or the like such as pearls and beads, is used, the pearls or the like are unlikely to catch on the brooch main body, and the narrow cord between adjacent pearls or the like can be passed through the chain insertion portion easily. Thus a brooch using this clasp for use with both a brooch and a pendant can be attached to the necklace easily.

If desired, the above-described stopper for latching the lower end of the leg, which extends from the vicinity of the pivot portion of the latch and closes the chain insertion portion formed by the support piece and the one surface of the brooch main body or the base of the support piece, is provided on the one surface of the brooch main body or the base of the support piece in the position at which the lower end of the leg abuts against or comes close to the one surface of the brooch main body or the base of the support piece. Hence, even if the needle-shaped latch is pushed inward from a position that is substantially parallel with the one surface of the brooch main body or the like, the leg and latch do not rotate any further, and the tip end of the latch does not move below the latch receiver. Thus the latch can always be latched easily to the latch receiver. Moreover, once a pendant chain has been passed through the chain insertion portion, the chain insertion portion can be closed securely by the leg of the latch, and hence the pendant chain does not become disengages from the chain insertion portion, enabling a great increase in the reliability of the clasp for use with both a brooch and a pendant.

DESCRIPTION OF THE PREFERRED EMBODIMENTS

A support piece having its tip end bent into a substantial right angle is provided on one surface of a brooch main body, and the rear end of a needle-shaped latch is supported on the tip end of the support piece so as to be free to rotate in a vertical direction. A leg protrudes at a substantial right angle from the vicinity of a pivot portion of the latch, and a space surrounded by the support piece and the one surface of the brooch main body forms a chain insertion portion. When a pendant chain is passed through the chain insertion portion of the support piece, and the tip end of the latch is latched by a latch receiver provided on the brooch main body, a lower end of the leg extending from the vicinity of the pivot portion of the latch abuts against or comes close to one surface of the brooch main body, thereby closing the chain insertion portion so that the pendant chain does not become disengaged from the chain insertion portion.

First Embodiment

A first embodiment of the present invention will now be described on the basis of the drawings.

Figure 1:
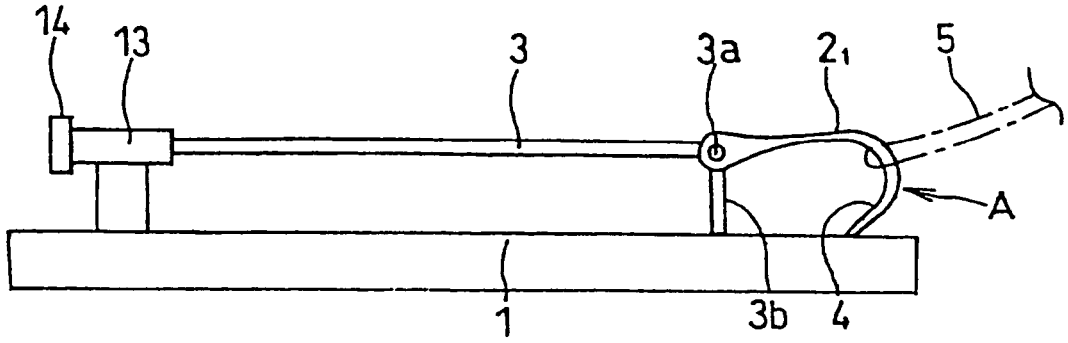
FIG. 1 is a side view showing a dual purpose clasp according to a first embodiment of the present invention with a pendant chain passed therethrough.
Figure 2:
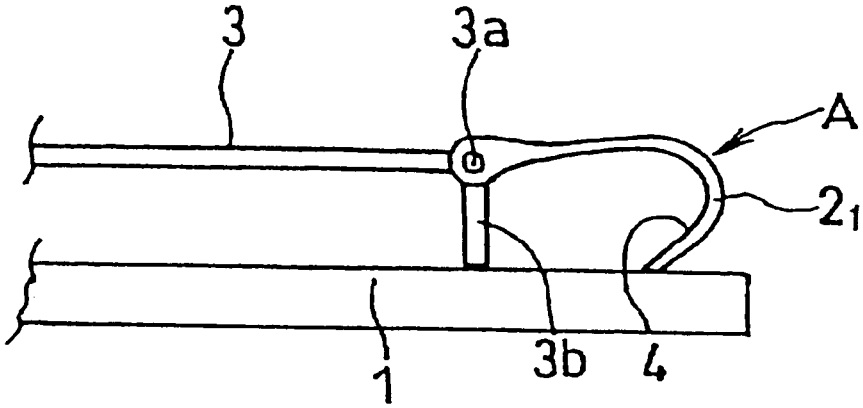
FIG. 2 is a partial side view of the dual purpose clasp according to the first embodiment of the present invention.

FIG. 2 shows the locations exhibiting the features of a clasp for use with both a brooch and a pendant (to be referred to hereinafter as a "dual purpose clasp") A according to the first embodiment of the present invention. In the dual purpose clasp A, the tip end (distal relative to the brooch main body) of a narrow support piece $\mathbf{2}_1$ standing on one end side of the rear surface of a brooch main body 1 is curved into a substantial right angle relative to an opposed opening of a latch receiver 13. Another end (proximal relative to the brooch main body 1) of the support piece $\mathbf{2}_1$ is functionally attached or otherwise functionally fixed to the brooch main body 1. A latch 3, the overall form of which is substantially L-shaped and the tip end of which is needle-shaped, is supported on the tip end of the support piece $\mathbf{2}_1$ so as to be free to rotate in a vertical direction about the curved portion of the support piece $\mathbf{2}_1$. The bent end of the latch 3 extending downward from a pivot portion 3*a* is provided as a leg 3*b*. Relative to the brooch main body 1 lying horizontally the support piece $\mathbf{2}_1$ has a bend such that a portion of the support piece $\mathbf{2}_1$ extends generally vertically from the bend towards the brooch main body 1 and another portion of the support piece $\mathbf{2}_1$ extends generally horizontally from the bend towards the latch receiver 13 and ends with the pivot portion 3*a*. As seen in FIGS. 1 and 2 the generally vertical and generally horizontal portions may have additional bends.

In this manner, the space surrounded by the support piece $\mathbf{2}_1$ and the rear surface of the brooch main body 1 constitutes a chain insertion portion 4. The term "surrounded by the support piece $\mathbf{2}_1$ and the rear surface of the brooch main body 1" permits additional elements to also surround the chain insertion portion 4. For example, as seen in FIG. 2, the leg 3*b* assists to define the chain insertion portion 4 in the closed position. As seen in another embodiment in FIGS. 4 and 5 an extended portion of the support piece $\mathbf{2}_1$ can also take part in surrounding the chain insertion portion.

When the tip end (free end) of the latch 3 of FIG. 1 is latched by a latch receiver 13, the lower end of the leg 3*b* abuts against or comes close to the rear surface of the brooch main body 1. As a result, the leg 3*b* closes the opening portion of the chain insertion portion 4.

Figure 3:
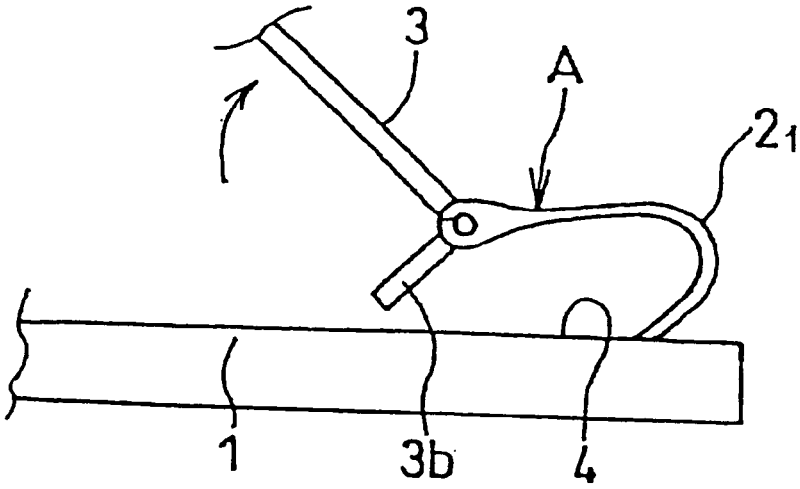
FIG. 3 is a partial side view showing the dual purpose clasp according to the first embodiment of the present invention with a needle-shaped latch open.

By releasing the free end of the latch 3, which is latched to the latch receiver 13, from the latch receiver 13 and raising the latch 3 upward as shown in FIG. 3, the leg 3*b* rotates (pivots) such that the leg 3*b* is separated from the rear surface of the brooch main body 1, thereby opening the opening portion of the chain insertion portion 4. An annular pendant chain 5 is then inserted into the chain insertion portion 4. The latch 3 is then lowered downward so that its free end is latched to the latch receiver 13 as shown in FIG. 1, whereby the leg 3*b* closes the opening portion of the chain insertion portion 4 so that the pendant chain 5 cannot become disengaged from the chain insertion portion 4.

When the dual purpose clasp A is used in this manner as a brooch clasp attached to the rear surface of the brooch main body 1, the dual purpose clasp A can easily be used with a pendant as well as a brooch. Furthermore, when the dual purpose clasp A is used with a pendant, the chain 5 is inserted into the narrow, closed chain insertion portion 4, and hence the position of the chain 5 does not shift greatly.

Second through fifth embodiments of the present invention will now be described on the basis of the drawings.

Here, description of identical constitutions to those of the first embodiment is omitted, and only the parts which differ from the first embodiment, or in other words the features of these embodiments, are described.

Second Embodiment

Figure 4:
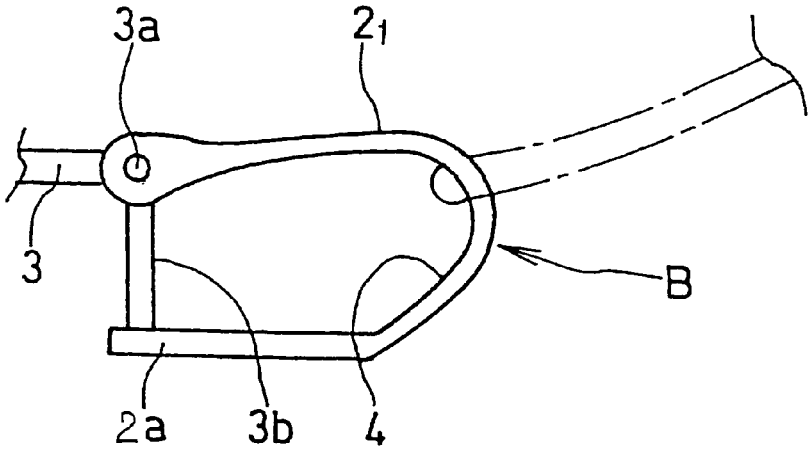
FIG. 4 is a partial side view showing a dual purpose clasp according to a second embodiment of the present invention with a pendant chain inserted through a chain insertion portion.
Figure 5:
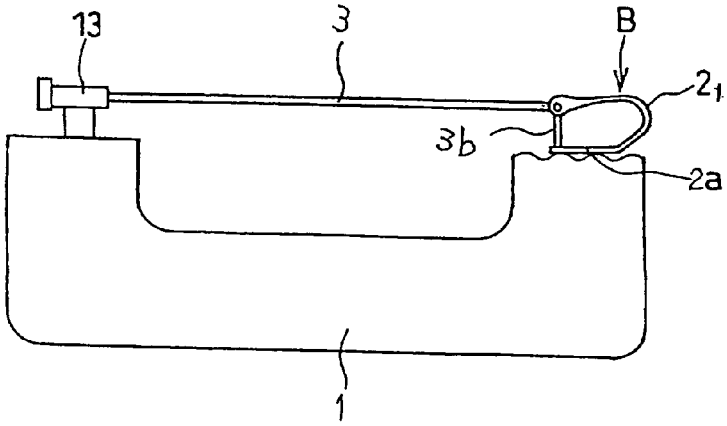
FIG. 5 is a side view showing the dual purpose clasp according to the second embodiment of the present invention attached to a brooch main body.

In a dual purpose clasp B according to the second embodiment, as shown in FIGS. 4 and 5, the rear end of the support piece $\mathbf{2}_1$ extends in a substantially identical direction to the bent tip end of the support piece $\mathbf{2}_1$ to form a base 2*a*. The chain insertion portion 4 is formed by the tip end of the support piece $\mathbf{2}_1$ and this base 2*a*, and the leg 3*b* extending from the vicinity of the pivot portion 3*a* of the latch 3 abuts against the base 2*a* to close the chain insertion portion 4. Here, the rear surface of the brooch main body 1 is an uneven surface rather than a constant even surface, and the base 2*a* of the support piece $\mathbf{2}_1$ is fixed to this uneven surface.

Figure 6:
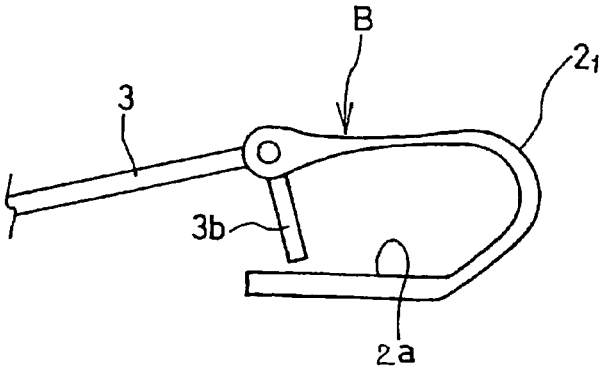
FIG. 6 is a partial side view showing the dual purpose clasp according to the second embodiment of the present invention with a tip end of a needle-shaped latch rotated below the position of a latch receiver.

In the case of the first and second embodiments, the leg 3*b* is provided, and hence the tip end of the latch 3 does not move below the latch receiver 13 even when pushed from above. However, if the latch 3 is pushed hard from above, the tip end of the latch 3 may move to a position below the latch receiver 13 as shown in FIG. 6, causing the leg 3*b* provided integrally with the latch 3 to rotate inside the chain insertion portion 4. In such a case, since the latch 3 and leg 3*b* are formed as an integral body, the leg 3*b* may catch on the surface of the brooch main body 1 or the base 2*a* when the latch 3 is raised, and hence it is troublesome to return the clasp to its normal state.

Third Embodiment

To avoid such a situation, a dual purpose clasp C of the third embodiment is provided as described below.

Figure 7:
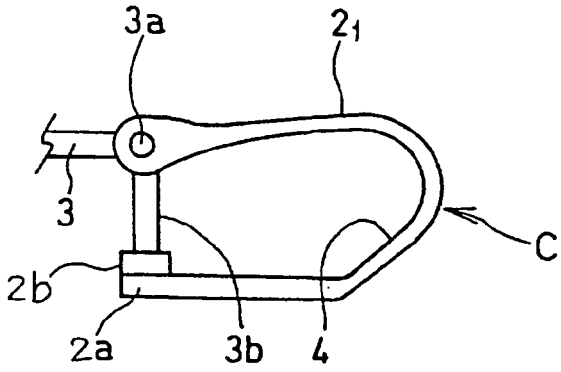
FIG. 7 is a partial side view showing a dual purpose clasp according to a third embodiment of the present invention with a stopper provided on a base and a leg latched to the stopper.
Figure 8:
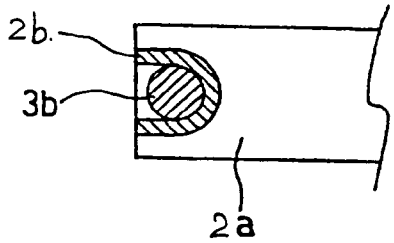
FIG. 8 is a partial plan view showing the dual purpose clasp according to the third embodiment of the present invention with the stopper provided on the base and the leg latched to the stopper.

In the dual purpose clasp C of the third embodiment, as shown in FIGS. 7 and 8, a stopper 2*b* having a substantially U-shaped surface is provided on the base 2*a*. By providing the stopper 2*b*, the lower end of the leg 3*b* is latched by the stopper 2*b* and thus prevented from rotating to the inside of the chain insertion portion 4. In the case of the first embodiment, where the support piece $\mathbf{2}_1$ is provided on the rear surface of the brooch main body 1, the stopper 2*b* may be provided in a similar manner on the rear surface of the brooch main body 1.

Figure 9:
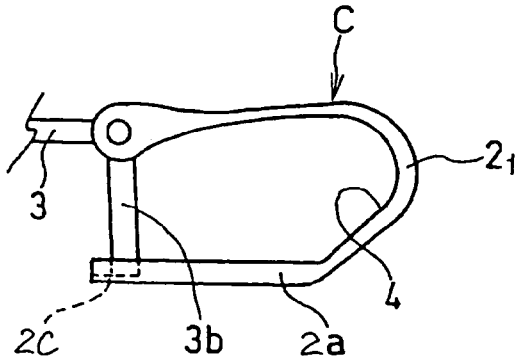
FIG. 9 is a partial side view showing the dual purpose clasp according to the third embodiment of the present invention with a recessed portion provided on the base and the leg latched to the recessed portion.
Figure 10:
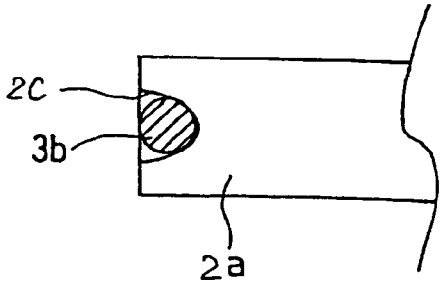
FIG. 10 is a partial plan view showing the dual purpose clasp according to the third embodiment of the present invention with the recessed portion provided on the base and the leg latched to the recessed portion.
Figure 11:
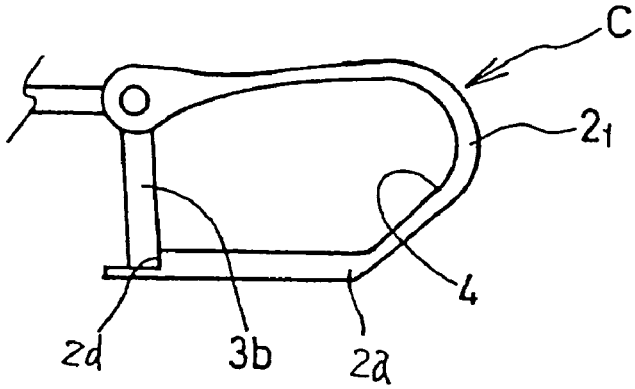
FIG. 11 is a partial side view showing the dual purpose clasp according to the third embodiment of the present invention with a stepped portion provided on the base and the leg latched to the stepped portion.

Instead of the stopper 2*b* having a substantially U-shaped surface, a recessed portion 2*c* having a substantially U-shaped surface may be provided on the edge of the base 2*a* which faces the latch receiver 13, as shown in FIGS. 9 and 10, such that the lower end of the leg 3*b* is latched by the recessed portion 2*c*. Alternatively, as shown in FIG. 11, a stepped portion 2*d* may be provided in the central portion of the edge of the base 2*a* which faces the latch receiver 13 such that the lower end of the leg 3*b* is latched by the stepped portion 2*d*.

Fourth Embodiment

Figure 12:
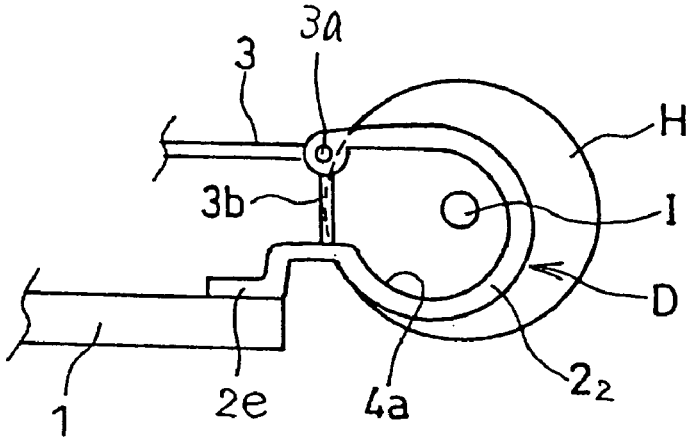
FIG. 12 is a partial end view showing a dual purpose clasp according to a fourth embodiment of the present invention with a cord of a pearl necklace passed through a chain insertion portion.

In a dual purpose clasp D according to the fourth embodiment, as shown in FIG. 12, a stepped base 2*e* protruding from the brooch main body 1 in a horizontal direction is formed in a position at one edge of the rear surface of the brooch main body 1, and the tip end of the stepped base 2*e* is formed into a support piece $\mathbf{2}_2$ which is bent into a substantially arc-shaped profile. The bent portion of the substantially L-shaped latch 3 is supported on the tip end of the support piece $\mathbf{2}_2$ so as to be free to rotate in a vertical direction, and the leg 3*b* is provided so as to protrude toward the surface of the stepped base 2*e* from the pivot portion 3*a* of the latch 3.

When the latch 3 is positioned substantially parallel with the rear surface of the brooch main body 1 so that the tip end (free end) thereof is latched by the latch receiver 13, the lower end of the leg 3*b* abuts against or comes close to the stepped base 2*e*, and as a result, the leg 3*b* closes the opening portion of a chain insertion portion 4*a* constituted by the space that is surrounded by the narrow support piece $\mathbf{2}_2$ bent into a substantially arc-shaped profile. This is similar to the embodiments described above. Further, the chain insertion portion 4*a* is formed in a position deviating to the side of the brooch main body 1.

An attempt may be made to pass a necklace formed by stringing together pearls H or beads having a large diameter through the chain insertion portion 4*a* of this invention. However, if the outer diameter of the pearls H is greater than the inner diameter of the chain insertion portion 4 when the support piece $\mathbf{2}_1$ is provided on the rear surface of the brooch main body 1 and the chain insertion portion 4 is formed on the rear surface of the brooch main body 1 as described above, the pearls H catch on the rear surface of the brooch main body 1, and a part of a cord I between two of the pearls H cannot be inserted into the chain insertion portion 4.

Figure 13:
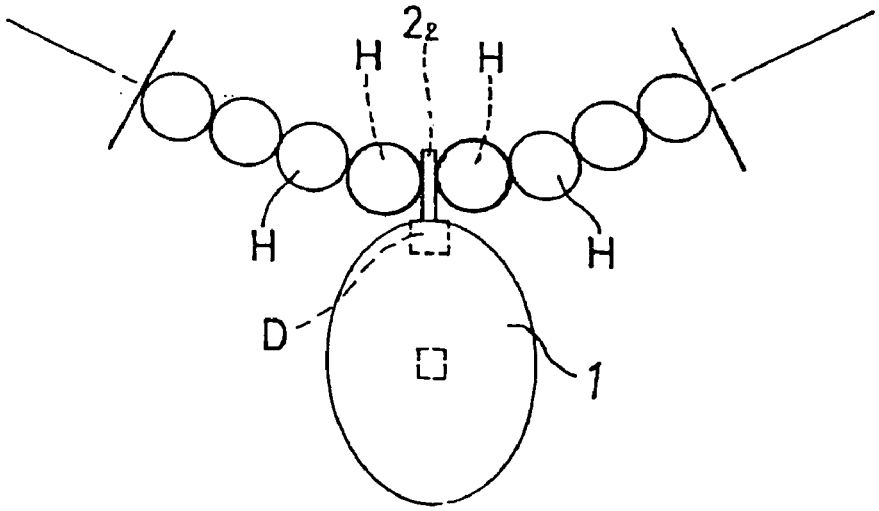
FIG. 13 is a partial front view showing a brooch attaching the dual purpose clasp according to the fourth embodiment of the present invention, and the brooch attached to a pearl necklace.

With the dual purpose clasp D of the fourth embodiment, however, the support piece $\mathbf{2}_2$ protrudes from one end of the brooch main body 1 in the horizontal direction, and the tip end thereof is bent into a substantially arc-shaped profile, as described above. Hence, when a necklace formed by stringing together the pearls H or beads, for example, is inserted into the chain insertion portion 4*a*, the part of the cord I between two adjacent pearls H can be fitted into the substantially arc-shaped chain insertion portion 4*a*, which is formed by the support piece $\mathbf{2}_2$ of the dual purpose clasp D, by raising the leg 3*b*. Thus, as shown in FIG. 13, the cord I can be inserted easily into the chain insertion portion 4*a* without the adjacent pearls H catching on the brooch main body 1, and the brooch main body 1 can be attached easily to the necklace.

Fifth Embodiment

Figure 14:
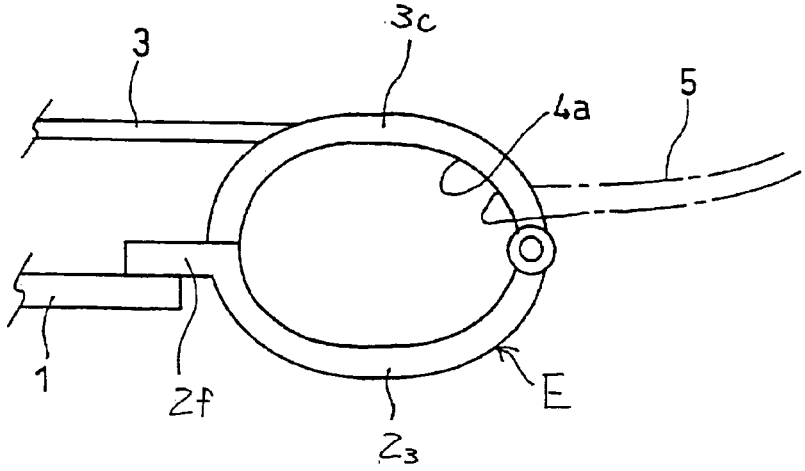
FIG. 14 is a partial side view showing a dual purpose clasp according to a fifth embodiment of the present invention.
Figure 15:
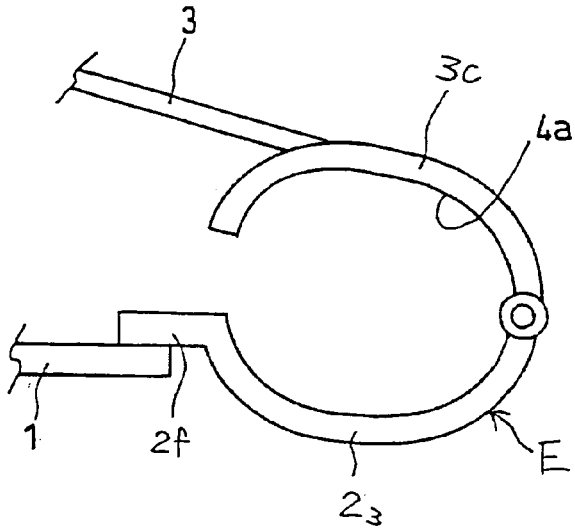
FIG. 15 is a partial side view showing the dual purpose clasp according to the fifth embodiment of the present invention with a latch and a latch base open.
Figure 16:
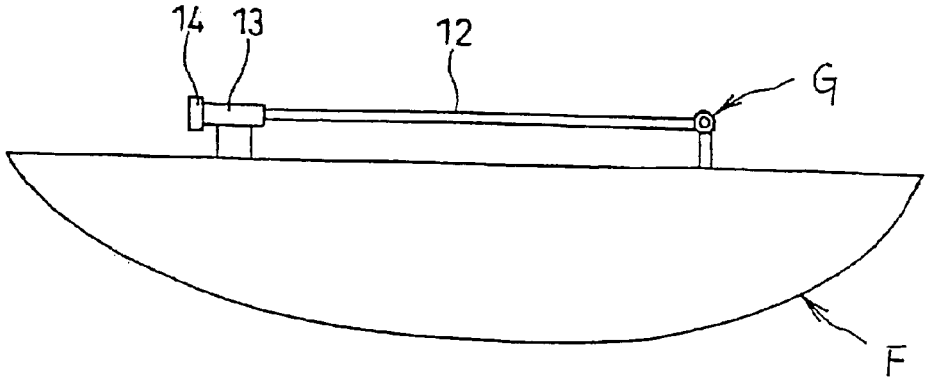
Fig. 16 (Prior Art)
FIG. 16 is a side view showing a conventional brooch clasp attached to a brooch.
Figure 17:
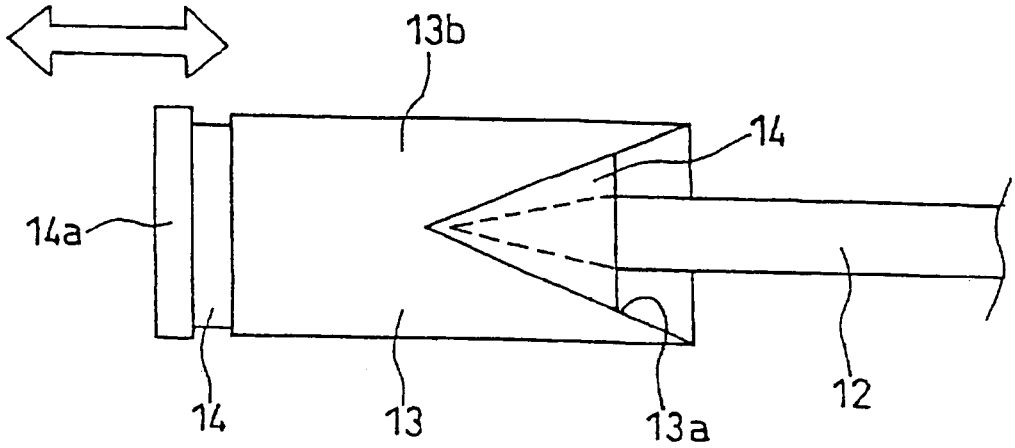
Fig. 17 (Prior Art)
FIG. 17 is a partial plan view showing a constitution in which a tip end of a needle-shaped latch on a conventional brooch clasp is latched freely to a latch receiver.
Figure 18:
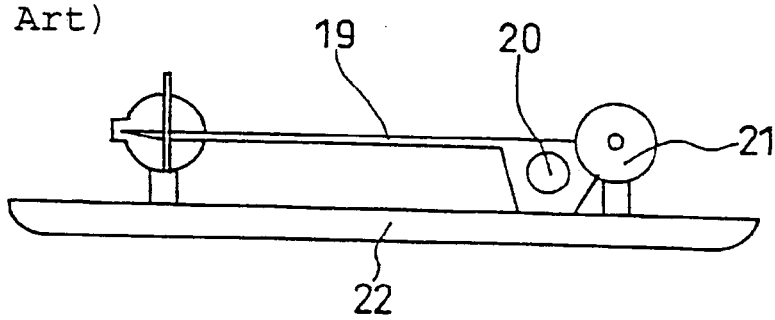
Fig. 18 (Prior Art)
FIG. 18 is a side view showing the constitution of a brooch pin disclosed in the laying open of Japanese Utility Model H6-9512.
Figure 19:
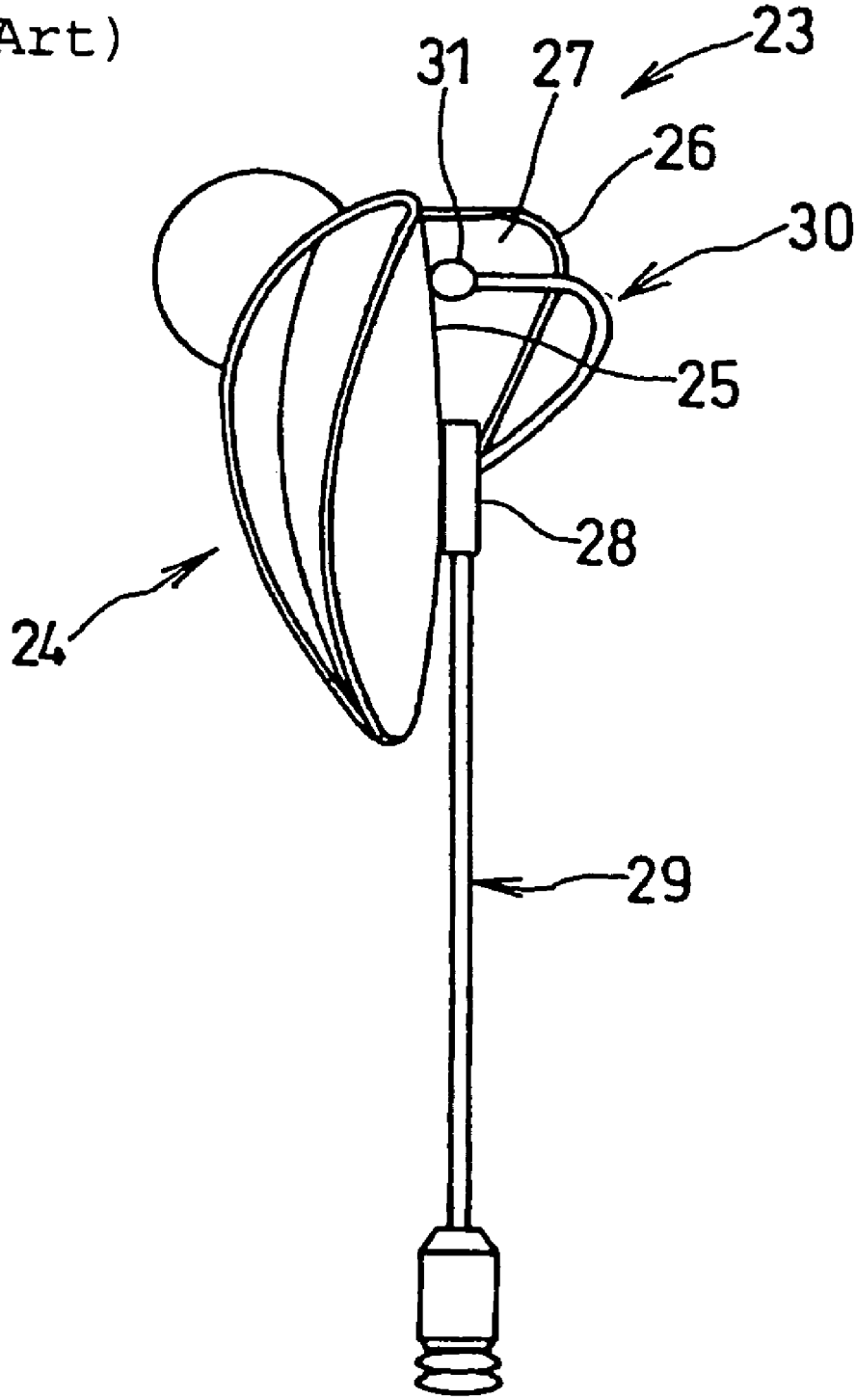
Fig. 19 (Prior Art)
FIG. 19 is a side view showing the constitution of a pin brooch provided with a pendant disclosed in Japanese Utility Model Registration Publication No. 3087633.

FIG. 14 shows a dual purpose clasp E according to the fifth embodiment in which a horizontal base 2*f* is fixed in a position on one edge of the rear surface of the brooch main body 1, and the tip end of the base 2*f* is formed into a support piece $\mathbf{2}_3$ bent into a substantially semi-arc shaped profile. One end of a latch base 3*c* having a substantially semi-arc shaped profile is supported on the tip end of the support piece $\mathbf{2}_3$ so as to be free to rotate in a vertical direction, and the other end is provided so as to be free to abut against or come close to the base 2*f*. An annular body is formed by the support piece $\mathbf{2}_3$ and the latch base 3*c*, and the space inside the annular body constitutes the circular chain insertion portion 4*a*. The needle-shaped latch 3 extends from the vicinity of the tip end of the latch base 3*c* to the aforementioned latch receiver. Note that the position of this chain insertion portion 4*a* also deviates to the side of the brooch main body 1.

Hence the free end of the latch base 3*c* functions similarly to the leg 3*b* in the embodiments described above. When the free end of the latch 3 is raised, the latch base 3*c* rotates about the pivot portion on the tip end of the support piece $\mathbf{2}_3$ such that the free end of the latch base 3*c* is separated from the tip end of the base 2*f*. As a result, the chain insertion portion 4*a* is opened and the pendant chain 5 is passed through the chain insertion portion 4*a*. When the tip end of the latch 3 is latched by the latch receiver, the free end of the latch base 3*c* abuts against or comes close to the tip end of the base 2*f*, thereby closing the chain insertion portion 4*a* so that the pendant chain 5 cannot become disengaged from the chain insertion portion 4*a*.

In the dual purpose clasp E of the fifth embodiment, similarly to the dual purpose clasp D described above, when a necklace formed by stringing together pearls or the like is inserted into the chain insertion portion 4*a*, adjacent pearls H do not catch on the rear surface of the brooch main body 1, and hence the necklace can be inserted into the chain insertion portion 4*a* easily, enabling the brooch main body 1 to be attached to the necklace easily. The reason for this is that in the fourth and fifth embodiments, the chain insertion portion 4*a* is provided to the side of the brooch main body 1, thus facilitating the insertion of a necklace chain or the like into the chain insertion portion 4*a*. Moreover, in the fifth embodiment, the chain insertion portion 4*a* is formed by the substantially semi-arc shaped support piece $\mathbf{2}_3$ and the latch base 3*c*, and hence when the latch base 3*c* is raised, the opening portion of the chain insertion portion 4*a* opens wide, further facilitating the insertion of a chain or the like.

In the embodiments described above, the latch receiver 13 described in the prior art section is used as the latch receiver 13 of the dual purpose clasps A, B, C, and D. However, the constitution of the latch receiver 13 is not an essential element of the present invention. Further, the present invention relates to a clasp, but the material of the support piece $\mathbf{2}_1$ and so on is not limited to metal, and a material other than metal may be used appropriately. Moreover, the latch for latching the leg 3*b* of the dual purpose clasp C is not limited to the stopper 2*b*, recessed portion 2*c*, and stepped portion 2*d*.

It is apparent that the present invention is not limited in spirit or scope to the embodiments specifically illustrated in the present application. Thus, the present invention is not limited to the above-identified description but is defined by the claims appended hereto.

What is claimed is:

1. A clasp for use with both a brooch and a pendant, comprising:

a needle-shaped latch, a rear end of the needle-shaped latch is supported on a first end of one surface of a brooch main body so as to be free to rotate in a vertical direction, a latch receiver for latching a tip end of the latch, which is provided on a second end of the one surface of the brooch main body, the clasp for being attached to a piece of clothing by latching the latch passed through a part of the piece of clothing to the latch receiver, and a narrow support piece, a tip end of the narrow support piece is bent into a substantial right angle to the direction of an opposed opening of the latch receiver, the narrow support piece is provided on the first end of the one surface of the brooch main body, the rear end of the needle-shaped latch is supported on the tip end of the support piece to be free to rotate in a vertical direction, a leg of the needle-shaped latch protrudes toward the first surface of the brooch main body from the vicinity of a pivot portion of the latch, and a space surrounded at least in part by the support piece forms a chain insertion portion, wherein the clasp is configured such that when a pendant chain is passed through the chain insertion portion of the support piece and the tip end of the latch is latched by the latch receiver provided on the other end of the one surface of the brooch main body, a lower end of the leg of the latch abuts against or comes close to the one surface of the brooch main body, thus closing the chain insertion portion so that the pendant chain cannot become disengaged from the chain insertion portion.

2. The clasp for use with both a brooch and a pendant according to claim 1, wherein the space surrounded by the support piece and the one end of the one surface of the brooch main body forms the chain insertion portion.

3. The clasp for use with both a brooch and a pendant according to claim 1, wherein a rear end of the support piece extends in a substantially identical direction to the bent tip end of the support piece to form a base, and the chain insertion portion is formed by the base and the support piece, wherein, when the leg extending from the vicinity of the pivot portion of the latch abuts against or comes close to the base, the chain insertion portion is closed.

4. The clasp for use with both a brooch and a pendant according to claim 1, wherein a stepped base protrudes from the brooch main body in a horizontal direction and is formed in a position at one edge of the rear surface of the brooch main body, and the tip end of the stepped base is formed into a support piece bent into a substantially arc-shaped profile.

5. The clasp for use with both a brooch and a pendant according to claim 1, wherein a stopper for latching the lower end of the leg, which extends from the vicinity of the pivot portion of the latch in order to close the chain insertion portion formed by the support piece and the one surface of the brooch main body or the base of the support piece, is provided on the one surface of the brooch main body or the base of the support piece in the position at which the lower end of the leg abuts against or comes close to the one surface of the brooch main body or the base of the support piece.

6. The clasp for use with both a brooch and a pendant according to claim 2, wherein a stopper for latching the lower end of the leg, which extends from the vicinity of the pivot portion of the latch in order to close the chain insertion portion formed by the support piece and the one surface of the brooch main body or the base of the support piece, is provided on the one surface of the brooch main body or the base of the support piece in the position at which the lower end of the leg abuts against or comes close to the one surface of the brooch main body or the base of the support piece.

7. The clasp for use with both a brooch and a pendant according to claim 3, wherein a stopper for latching the lower end of the leg, which extends from the vicinity of the pivot portion of the latch in order to close the chain insertion portion formed by the support piece and the one surface of the brooch main body or the base of the support piece, is provided on the one surface of the brooch main body or the base of the support piece in the position at which the lower end of the leg abuts against or comes close to the one surface of the brooch main body or the base of the support piece.

8. The clasp for use with both a brooch and a pendant according to claim 4, wherein a stopper for latching the lower end of the leg, which extends from the vicinity of the pivot portion of the latch in order to close the chain insertion portion formed by the support piece and the one surface of the brooch main body or the base of the support piece, is provided on the one surface of the brooch main body or the base of the support piece in the position at which the lower end of the leg abuts against or comes close to the one surface of the brooch main body or the base of the support piece.

9. A clasp for use with both a brooch and a pendant, comprising:

a needle-shaped latch, a rear end of the needle-shaped latch is supported on one end of one surface of a brooch main body so as to be free to rotate in a vertical direction, a latch receiver for latching a tip end of the latch, which is provided on another end of the one surface of the brooch main body, the clasp being attachable to a piece of clothing by latching the latch passed through a part of the piece of clothing to the latch receiver, and a horizontal base fixed to one edge of the one surface of the brooch main body, a tip end of the base is formed into a support piece bent into an arc-shaped profile, one end of a latch base having an arc-shaped profile is supported on the tip end of the support piece so as to be free to rotate in a vertical direction, another end of the latch base is provided so as to be free to abut against or come close to the horizontal base, an annular body protruding from the one end of the brooch main body is formed by the support piece and the latch base, the space inside the annular body constitutes a chain insertion portion, and the needle-shaped latch portion is provided from the latch base to the latch receiver, wherein the clasp is configured such that when a pendant chain is passed through the chain insertion portion and the tip end of the latch is latched by the latch receiver, the chain insertion portion is closed by the latch base so that the pendant chain cannot become disengaged from the chain insertion portion.

10. The clasp for use with both a brooch and a pendant according to claim 9, wherein a stopper for latching another end of the latch base in order to close the chain insertion portion constituted by the space inside the annular body formed by the support piece and the latch base, is provided on the base of the support piece or the support piece in the position at which another end of the latch base abuts against or comes close to the base of the support piece.

* * * * *

UNITED STATES PATENT AND TRADEMARK OFFICE

CERTIFICATE OF CORRECTION

PATENT NO. : 7,120,974 B2
APPLICATION NO. : 10/927593
DATED : October 17, 2006
INVENTOR(S) : Suganuma It is certified that error appears in the above-identified patent and that said Letters Patent is hereby corrected as shown below:

On Title Page, Item (30)
In the Foreign Application Priority Data

"Aug. 28, 2003 (JP) .....2003-004410", should read:

--Aug. 28, 2003 (JP).....2003-004410--
--Nov. 13, 2003 (JP).....2003-384280--

Signed and Sealed this

Thirtieth Day of January, 2007

JON W. DUDAS
*Director of the United States Patent and Trademark Office*